US009162472B2

(12) United States Patent
Koike et al.

(10) Patent No.: US 9,162,472 B2
(45) **Date of Patent: *Oct. 20, 2015**

(54) FILTER UNIT, LIQUID EJECTING APPARATUS, AND BUBBLE REMOVAL METHOD

(71) Applicant: SEIKO EPSON CORPORATION, Tokyo (JP)

(72) Inventors: Kaoru Koike, Matsumoto (JP); Toshio Kumagai, Shiojiri (JP); Masaaki Ando, Matsumoto (JP); Haruhisa Uezawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 1 day.

This patent is subject to a terminal disclaimer.

(21) Appl. No.: 14/079,855

(22) Filed: Nov. 14, 2013

(65) Prior Publication Data

US 2014/0071214 A1 Mar. 13, 2014

Related U.S. Application Data

(63) Continuation of application No. 13/590,923, filed on Aug. 21, 2012, now Pat. No. 8,596,775.

(30) Foreign Application Priority Data

Aug. 23, 2011 (JP) ..... 2011-181291

(51) Int. Cl.
*B41J 2/18* (2006.01)
*B41J 2/19* (2006.01)
(Continued)

(52) U.S. Cl.
CPC .. *B41J 2/19* (2013.01); *B41J 2/175* (2013.01); *B41J 2/17563* (2013.01); *B41J 2/18* (2013.01); *B41J 29/38* (2013.01)

(58) Field of Classification Search
CPC ..... B41J 2/19; B41J 2/175; B41J 2/18; B41J 2/17563; B41J 29/38
See application file for complete search history.

(56) References Cited

U.S. PATENT DOCUMENTS 6,398,354 B1 6/2002 Lattuca et al.
6,520,633 B2 2/2003 Nakamura
(Continued)

FOREIGN PATENT DOCUMENTS

JP 2007-313703 12/2007
JP 2008-207460 9/2008

OTHER PUBLICATIONS

U.S. Appl. No. 13/590,923, May 3, 2013, Office Action.
(Continued)

*Primary Examiner* — David A Reifsnyder
(74) *Attorney, Agent, or Firm* — Workman Nydegger

(57) ABSTRACT

A filter unit includes: a space portion, through which a liquid passes, whose outer cross-sectional shape when cut along the direction orthogonal to the axial direction is circular or polygonal; a filter provided at the surface on one end side of the space portion in the axial direction thereof; a protruding member, provided at the surface on the other end side of the space portion in the axial direction thereof, that protrudes toward a center area of the surface on the one end side of the space portion; an inflow channel that allows the liquid to flow into the space portion from a direction tangential to the side circumferential surface of the space portion; and an outflow channel that allows the liquid to pass through the filter and flow out from the space portion.

6 Claims, 6 Drawing Sheets

(51) Int. Cl.
*B41J 2/175* (2006.01)
*B41J 29/38* (2006.01)

(56) References Cited

U.S. PATENT DOCUMENTS 6,749,296 B2 6/2004 Usui et al.
7,063,414 B2 6/2006 Harakawa
7,819,514 B2 10/2010 Uezawa
8,080,093 B2 12/2011 Ito et al.
8,596,775 B2 * 12/2013 Koike et al. ..... 347/93

OTHER PUBLICATIONS

U.S. Appl. No. 13/590,923, Aug. 22, 2013, Notice of Allowance.

* cited by examiner

< PRINTING MODE >

< MAINTENANCE MODE >

FILTER UNIT, LIQUID EJECTING APPARATUS, AND BUBBLE REMOVAL METHOD

This application is a continuation of U.S. patent application Ser. No. 13/590,923, filed Aug. 21, 2012, now U.S. Pat. No. 8,596,775, which claims priority to Japanese Patent Application No. 2011-181291, filed Aug. 23, 2011, which applications are expressly incorporated by reference herein.

BACKGROUND

1. Technical Field

The present invention relates to filter units, liquid ejecting apparatuses, and bubble removal methods.

2. Related Art

An ink jet printer (called a "printer" hereinafter) that ejects ink (a liquid) from nozzles provided in a head is known as one example of a liquid ejecting apparatus. In such a printer, the ink is ejected from the nozzles by applying pressure to ink within ink chambers that communicate with the nozzles and that are filled with the ink. If bubbles become intermixed with the ink within the head, pressure cannot be properly applied to the ink, and ejection problems and the like occur as a result.

Accordingly, there is a printer in which a filter is provided within the head; in a printing mode, the filter catches bubbles that have intermixed with the ink, whereas in a maintenance mode, the bubbles pass through the filter, and the bubbles are then discharged to the exterior of the head. Furthermore, a printer has been proposed in which a bubble catching unit is provided so that bubbles make contact with a filter and a set region of the filter is kept in a blocked state, so that it is easier for the bubbles to pass through the filter during the maintenance mode (for example, see JP-A-2007-313703).

However, fine bubbles do not easily flow with the current of the ink, and do not easily come into contact with the filter if the fine bubbles rise due to buoyancy; accordingly, there has been a problem in that such fine bubbles have been unable to pass through the filter during the maintenance mode, and have remained within the filter unit. Particularly in the case where maintenance that ejects ink from the nozzles is executed by applying pressure to the ink within the head, the bubbles are compressed and shrink, which causes even more bubbles to remain within the filter unit.

SUMMARY

It is an advantage of some aspects of the invention to improve the ability to remove bubbles from a liquid (ink) within a filter unit.

A filter unit according to an aspect of the invention includes: a space portion, through which a liquid passes, whose outer cross-sectional shape when cut along the direction orthogonal to the axial direction is circular or polygonal; a filter provided at the surface on one end of the space portion in the axial direction thereof; a protruding member, provided at the surface on the other end of the space portion in the axial direction thereof, that protrudes toward a center area of the surface on the one end of the space portion; an inflow channel that allows the liquid to flow into the space portion from a direction tangential to the side circumferential surface of the space portion; and an outflow channel that allows the liquid to pass through the filter and flow out from the space portion.

Other features of the invention will be made clear by the descriptions in this specification and the appended drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Outline of the Disclosure

Figure 1A:
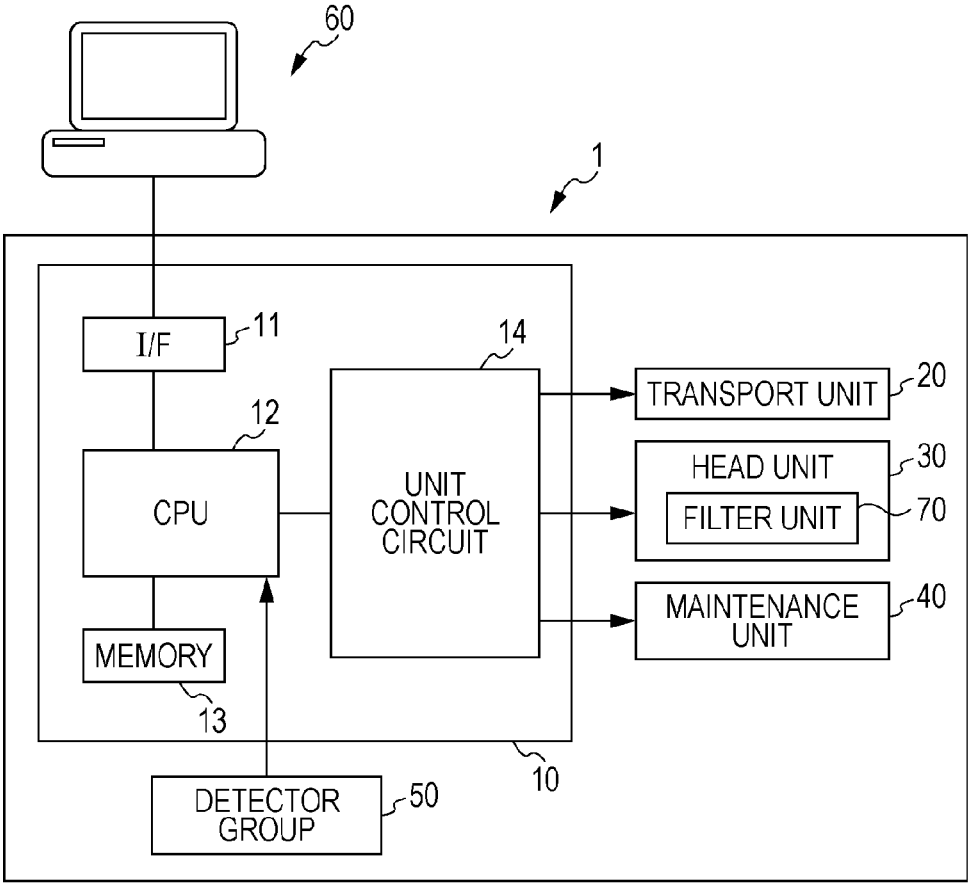
FIG. 1A is a block diagram illustrating the overall configuration of a printer.

At least the following will be made clear through the descriptions in this specification and the content of the appended drawings.

That is, a filter unit includes: a space portion, through which a liquid passes, whose outer cross-sectional shape when cut along the direction orthogonal to the axial direction is circular or polygonal; a filter provided at the surface on one end of the space portion in the axial direction thereof; a protruding member, provided at the surface on the other end of the space portion in the axial direction thereof, that protrudes toward a center area of the surface on the one end of the space portion; an inflow channel that allows the liquid to flow into the space portion from a direction tangential to the side circumferential surface of the space portion; and an outflow channel that allows the liquid to pass through the filter and flow out from the space portion.

According to this filter unit, the liquid within the space portion can be caused to flow rotationally by adjusting the speed at which the liquid flows into the space portion, which makes it possible to bring the bubbles toward the filter along the protruding member while the bubbles move toward the center area of the space portion due to centrifugal force; this in turn makes it possible to allow more bubbles to flow out downstream from the filter. Accordingly, the ability to remove bubbles from the liquid within the filter unit can be improved.

In the stated filter unit, it is preferable that the protruding member have a circular conical shape whose apex points toward the one end side of the space portion in the axial direction.

According to this filter unit, the bubbles can be brought smoothly toward the filter, and the bubbles can be prevented from accumulating at the protruding member, which makes it possible to allow more bubbles to flow out downstream from the filter.

In the stated filter unit, it is preferable that the apex of the protruding member make contact with the filter.

According to this filter unit, the interval between the protruding member and the filter is narrow, and thus even fine bubbles can be caused to make contact with the filter; furthermore, bubbles can be prevented from accumulating between the protruding member and the filter, and thus more bubbles can be allowed to flow out downstream from the filter.

Meanwhile, a liquid ejecting apparatus includes the stated filter unit, a liquid holding unit that holds the liquid, and a head provided with a nozzle capable of ejecting the liquid. Here, the filter unit is provided between the liquid holding unit and the nozzle, and includes a first mode that causes the liquid to flow into the space portion from the inflow channel at a flow speed that does not allow bubbles contained in the liquid to flow out downstream from the filter, and a second mode that causes the liquid to flow into the space portion from the inflow channel at a flow speed that allows bubbles contained in the liquid to flow out downstream from the filter.

According to this liquid ejecting apparatus, cases where pressure is not properly applied to the liquid within the head due to the bubbles, where the supply of liquid to the head is inhibited by the bubbles, and so on can be prevented, which makes it possible to prevent liquid ejection problems in the nozzles.

In the stated liquid ejecting apparatus, it is preferable that a dynamic pressure applied to the liquid in the second mode be a pressure that enables bubbles contained in the liquid to pass through the filter.

According to this liquid ejecting apparatus, the bubbles can be allowed to flow out downstream from the filter during the second mode.

In the stated liquid ejecting apparatus, in the second mode, it is preferable that the liquid be ejected from the nozzle by pressure-transferring the liquid from the liquid holding unit into the head and applying pressure to the liquid within the head.

According to this liquid ejecting apparatus, the ability to remove bubbles from the liquid within the filter unit can be improved even in the case where the bubbles have shrunk and have difficulty passing through the filter.

Meanwhile, a bubble removal method removes bubbles contained in the liquid within the filter unit by executing the stated second mode.

According to this bubble removal method, causing the liquid within the space portion to flow rotationally makes it possible to bring the bubbles toward the filter along the protruding member while the bubbles move toward the center area of the space portion due to centrifugal force; this in turn makes it possible to allow more bubbles to flow out downstream from the filter. Accordingly, the ability to remove bubbles from the liquid within the filter unit can be improved.

Printing System

An embodiment will now be described using, as an example, a printing system in which an ink jet printer (called a "printer" hereinafter) and a computer are connected, where the ink jet printer serves as a "liquid ejecting apparatus."

Figure 1B:
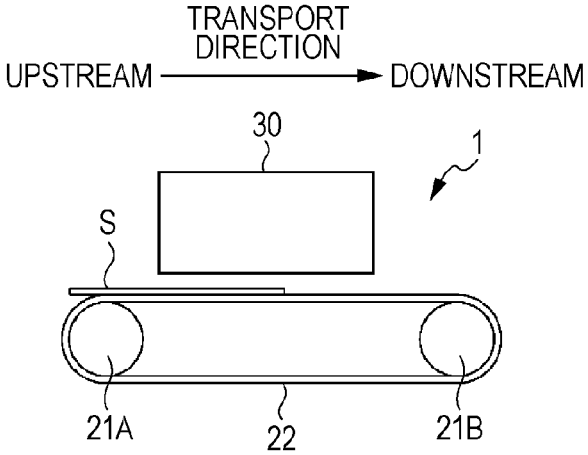
FIG. 1B is a general cross-sectional view of the printer.
Figure 2:
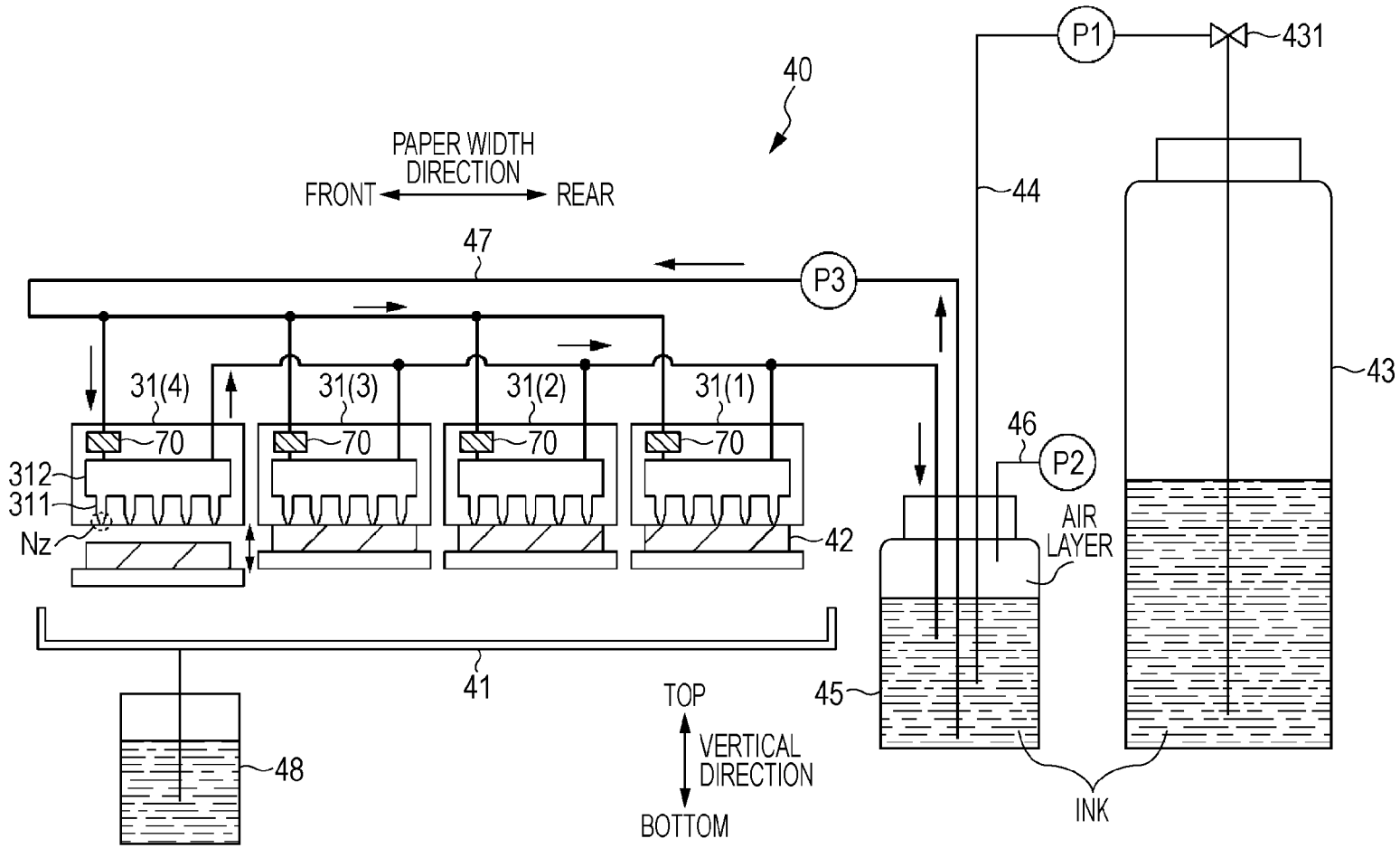
FIG. 2 is a diagram illustrating an ink supply path.

FIG. 1A is a block diagram illustrating the overall configuration of a printer 1, and FIG. 1B is a general cross-sectional view of the printer 1. FIG. 2 is a diagram illustrating an ink supply path.

A computer 60 is connected to the printer 1 in a communicable state, and outputs, to the printer 1, print data for causing the printer 1 to print images.

A controller 10 within the printer 1 is an element for performing the overall control of the printer 1. An interface unit 11 serves to exchange data with the computer 60, which is an external device. A CPU 12 is a computational processing device for performing the overall control of the printer 1, and controls various units via a unit control circuit 14. A memory 13 is an element for securing a region for storing programs executed by the CPU 12, a work region, and so on. Meanwhile, a detector group 50 monitors conditions within the printer 1, and the controller 10 controls the various units based on detection results from the detector group 50.

A transport unit 20 is a unit for transporting a recording medium such as paper, cloth, or film (called a "medium S" hereinafter) from upstream to downstream in a transport direction. As shown in FIG. 1B, the medium S is transported, at a constant speed and without stopping, upon a transport belt 22 that is cycled by transport rollers 21A and 21B, while opposing the bottom surface of a head unit 30.

The head unit 30 is a unit for ejecting ink through the nozzles toward the medium S to which the head unit 30 is opposed. Four heads 31(1) to 31(4) are provided on the bottom surface of the head unit 30, and are arranged in a paper width direction that is orthogonal to the transport direction. Nozzle openings from which ink can be ejected are provided in the bottom surface of each head 31. Accordingly, a two-dimensional image, in which a plurality of dot rows that follow the transport direction are arranged in the paper width direction, is printed by ejecting ink through the nozzles toward the medium S that moves below the head unit 30 in the transport direction.

As shown in FIG. 2, each head 31 includes nozzles Nz, ink chambers 311 provided for each nozzle Nz and that communicate with each corresponding nozzle Nz, a common ink chamber 312 that communicates with the plurality of ink chambers 311, and a filter unit 70. The filter unit 70 is provided upstream from the common ink chamber 312 in an ink supply path, and is a unit for preventing bubbles, foreign objects (thickened ink, debris, and the like) from flowing to the common ink chamber 312 during a printing mode (details will be given later).

Note that the technique for ejecting ink through the nozzles may be a piezoelectric-based technique that ejects ink by applying a voltage to driving elements (piezoelectric elements) and causing the ink chambers 311 that communicate with the nozzles to expand/shrink, or may be a thermal-based technique that ejects ink by using driving elements (thermal elements) to produce bubbles within the nozzles Nz and using those bubbles to eject the ink.

A maintenance unit 40 is a unit for removing bubbles from the ink within the heads 31, ink flow channels, and so on by supplying and filling ink in the heads 31, the ink flow channels, and so on (details will be given later).

Configuration of Maintenance Unit 40

The maintenance unit 40 includes: a supply pump P1; a pressure adjustment pump P2 and an air tube 46 connected thereto; a circulation pump P3; an ink cartridge 43 and a sub tank 45 that hold ink; a supply tube 44; a circulation tube 47; an on/off valve 431; an ink receiving portion 41; caps 42; and a waste liquid tank 48. The maintenance unit 40 is located in a non-printing region further toward the far side in the paper width direction than a printing region (a region in which the medium S is transported upon the transport belt 22).

The ink cartridge 43 and the sub tank 45 communicate via the supply tube 44, and the on/off valve 431 and the supply pump P1 are provided partway along the supply tube 44. The ink within the ink cartridge 43 is supplied to the sub tank 45 by the operation of the supply pump P1.

Both ends of the circulation tube 47 are provided in the sub tank 45, and the circulation pump P3 and four heads 31(1) to 31(4) are provided partway along the circulation tube 47. Accordingly, the ink within the sub tank 45 can, due to the operation of the circulation pump P3, flow through the interiors of the heads 31 while flowing in the circulation tube 47, and then return again to the sub tank 45. In other words, the ink within the sub tank 45 circulates. Note that the circulation pump P3 is provided further upstream in the ink supply path than the heads 31. Meanwhile, an end of the air tube 46 that is connected to the pressure adjustment pump P2 is located in an air layer in the sub tank 45.

The caps 42 are approximately rectangular members (for example, elastic members), and are provided for each of the heads 31. The four caps 42 are provided in the non-printing region, in locations corresponding to the locations of the four heads 31(1) to 31(4) in the head unit 30. Accordingly, when the head unit 30 moves to the non-printing region during the maintenance mode, the nozzle opening surfaces (bottom surfaces) of the heads 31 and the caps 42 are positioned opposite one other. The caps 42 are capable of ascending/descending in the vertical direction, and can fit on (make contact with) the nozzle opening surfaces of the heads 31. When the caps 42 fit on the nozzle opening surfaces of the heads 31, the respective nozzle openings are independently sealed and put into a state in which the nozzles cannot communicate with the atmosphere.

The ink receiving portion 41 is provided in a location that is opposite to the nozzle opening surfaces of the heads 31 (below the caps 42) during the maintenance mode, and is an element for receiving ink ejected from the nozzles Nz. The ink received by the ink receiving portion 41 is collected in the waste liquid tank 48.

Printing Mode and Maintenance Mode

Printing Mode

The printer 1 according to this embodiment has a printing mode and a maintenance mode. The printing mode is a mode in which images are printed onto the medium S. The head unit 30 is located above the transport belt 22 during the printing mode, and is opposed to the medium S that is transported upon the transport belt 22.

During the printing mode, the controller 10 supplies air to the air layer of the sub tank 45 by driving the pressure adjustment pump P2, which pressurizes the interior of the sub tank 45 to a pressure that is higher than the atmospheric pressure. Doing so makes it possible to supply the ink within the sub tank 45 to the heads 31 via the circulation tube 47 even if the ink within the heads 31 has been consumed for printing.

Maintenance Mode

The maintenance mode is a mode for removing bubbles that have intermixed in the heads 31, the ink flow channels, and so on. In the case where the printer 1 is not being used for a long period of time, air can be suppressed from entering through the nozzle openings by fitting the caps 42 onto the nozzle opening surfaces of the heads 31. However, it is difficult to completely prevent the entry of air, and thus bubbles (air) enter into the ink within the heads 31, the ink flow channels, and so on when the printer 1 is not being used for a long period of time. It is also easy for air to intermix in the heads 31, the ink flow channels, and so on when replacing the ink cartridge 43 or the like.

If bubbles are intermixed in the ink within the heads 31, the ink flow channels, or the like, the bubbles can interfere with the flow of ink, which can result in an insufficient supply of ink, an inability to apply proper pressure to the ink within the ink chambers 311, and so on, which in turn results in the ink not being properly ejected through the nozzles Nz.

Accordingly, the printer 1 according to this embodiment executes the maintenance mode after the printer 1 has been stopped for a long period of time (for example, when starting operations after one day has passed), after the ink cartridge 43 or the like has been replaced, and so on. However, the invention is not limited thereto, and the maintenance mode may, for example, be executed periodically during printing processes. Meanwhile, the heads 31, the ink flow channels, and the like are filled with ink as a result of the maintenance mode being executed. Accordingly, the maintenance mode may also be executed for the purpose of carrying out an initial fill of the ink after the heads 31, the ink flow channels, and the like have been cleaned, replaced, and so on.

Hereinafter, details of the flow of the maintenance mode will be described.

First, the controller 10 of the printer 1 opens the on/off valve 431 provided partway along the supply tube 44, operates the supply pump P1, and supplies a predetermined amount of ink from the ink cartridge 43 to the sub tank 45. After the sub tank 45 has been filled with ink, the controller 10 closes the on/off valve 431, which suppresses the ink from flowing between the ink cartridge 43 and the sub tank 45.

Next, the controller 10 causes the nozzle opening surfaces of the heads 31 to oppose the upper surfaces of the caps 42, raises the caps 42, and fits the caps 42 onto the nozzle opening surfaces of the heads 31. As a result, the nozzle openings in the respective heads 31 are independently sealed and put into a state in which the nozzles cannot communicate with the atmosphere.

Next, the controller 10 operates the circulation pump P3, and as a result, ink circulates through the sub tank 45, the heads 31, and the circulation tube 47. Specifically, first, the ink within the sub tank 45 is pressure-transferred to the heads 31 through the circulation tube 47, after which the ink within the heads 31 passes through the circulation tube 47 and returns to the sub tank 45. Note that at this time, the air layer within the sub tank 45 is at atmospheric pressure. In addition, because the caps 42 are fitted on the nozzle opening surfaces of the heads 31, ink is suppressed from leaking from the nozzle openings.

In this manner, bubbles that are intermixed with the ink in the heads 31, the circulation tube 47, and so on are sent to the sub tank 45 along with the ink by circulating the ink through the sub tank 45, the heads 31, and the circulation tube 47. In the sub tank 45, the bubbles impact the liquid surface of the ink and burst, which removes the bubbles from the ink within the sub tank 45. In this manner, bubbles are removed from the ink within the heads 31 and the circulation tube 47, and the heads 31 and circulation tube 47 are filled with ink.

However, it is difficult for the ink to fill fine spaces such as the nozzles Nz, and thus there is the risk that air (bubbles) will remain within the nozzles Nz even after the ink has been circulated by the circulation pump P3. Accordingly, the controller 10 then supplies air to the air layer of the sub tank 45 by operating the pressure adjustment pump P2, which pressurizes the interior of the sub tank 45 to a pressure that is higher than the atmospheric pressure. By doing so, the ink within the sub tank 45 is pressurized, the ink is pressure-transferred from the sub tank 45 to the heads 31, and the ink within the heads 31 is also pressurized.

After this, the controller 10 lowers the caps 42 that were fitted on the nozzle opening surfaces of the heads 31, thus distancing the caps 42 from the heads 31. Because the ink within the heads 31 is pressurized at this time by the pressure adjustment pump P2, ink is forcefully ejected from the nozzles Nz. As a result, air is discharged along with the ink from the nozzles Nz, and the nozzles Nz are also filled with ink. The controller 10 stops operating the pressure adjustment pump P2 after a predetermined amount of ink has been ejected from the nozzles Nz. In this manner, the heads 31 and the circulation tube 47 can be filled with ink while also removing bubbles from the ink within the heads 31 and the circulation tube 47.

Note that ink may be ejected from the nozzles Nz by using the pressure adjustment pump P2 to pressurize the ink within the sub tank 45 after the caps 42 have been distanced from the heads 31. Furthermore, the sub tank 45 may be omitted, and the ink may be circulated through a circulation tube that spans between the ink cartridge 43 and the heads 31.

Filter Unit 70

Configuration of Filter Unit 70

Figure 3A:
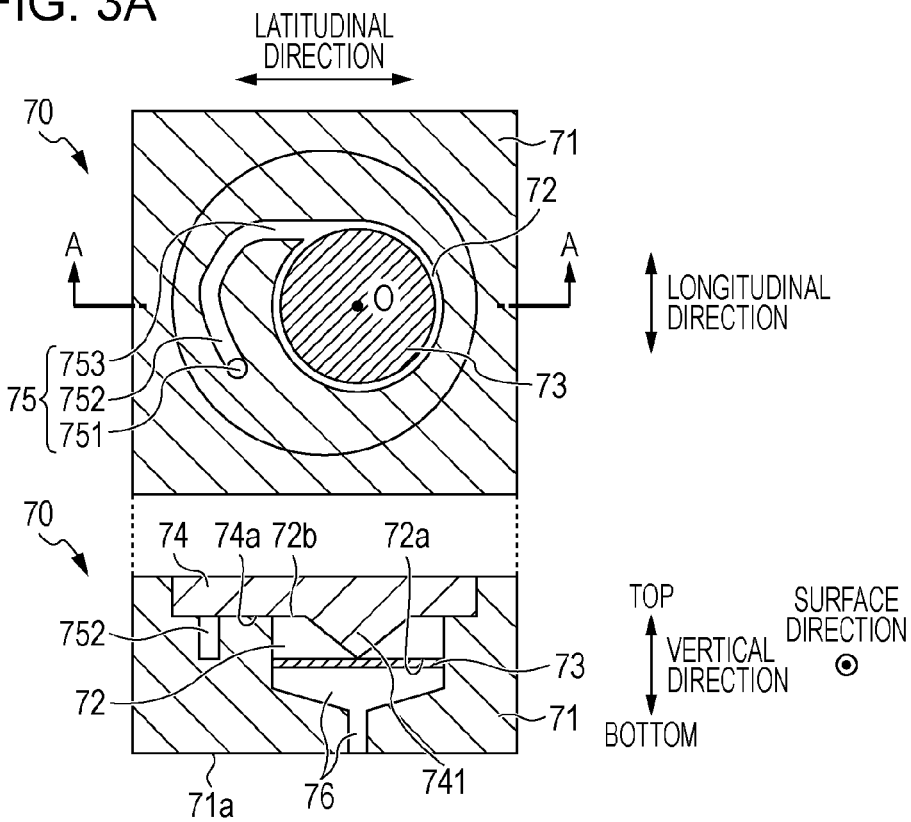
FIG. 3A is a diagram illustrating the configuration of a filter unit.
Figure 3B:
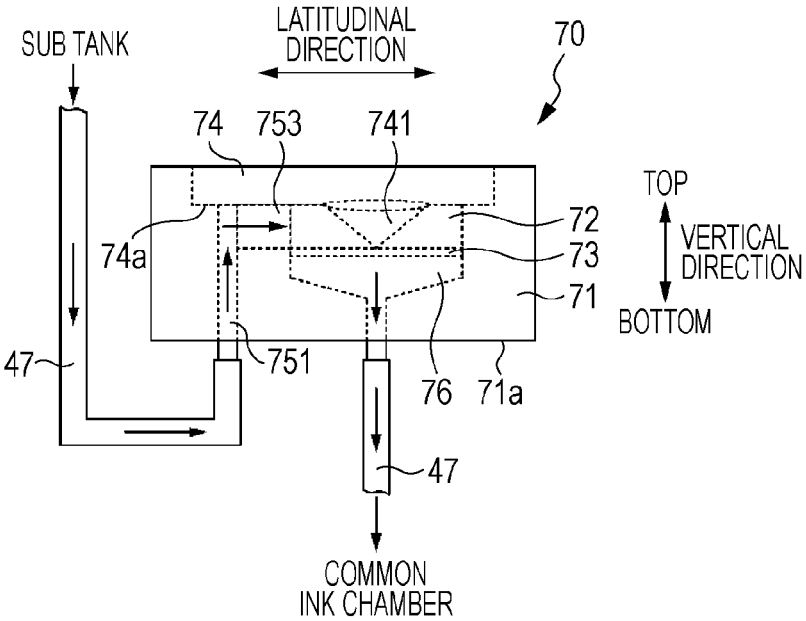
FIG. 3B is a diagram illustrating the flow of ink that passes through the filter unit.

FIG. 3A is a diagram illustrating the configuration of the filter unit 70, and FIG. 3B is a diagram illustrating the flow of ink that passes through the filter unit 70. The upper section of FIG. 3A illustrates the filter unit 70 from above in a state in which a filter cover 74 has been removed, and the lower section of FIG. 3A is a cross-sectional view of the filter unit 70 in which the central area (a position A-A) in the longitudinal direction of the filter unit 70 has been cut in the vertical direction. Meanwhile, FIG. 3B is an external view showing a main body unit 71 of the filter unit 70 and the circulation tube 47 from the longitudinal direction orthogonal to the vertical direction, where a filter chamber 72 and the like provided within the main body unit 71 are indicated virtually by dotted lines.

The filter unit 70 includes: the main body unit 71; the filter chamber 72; a filter 73; the filter cover 74; an ink inflow channel 75; and an ink outflow channel 76. The filter chamber 72, the ink inflow channel 75, and the ink outflow channel 76 are spaces through which ink passes. The filter 73 is a circular thin plate in which many fine holes are provided (for example, a metal mesh).

As shown in the upper section of FIG. 3A, the filter chamber 72 is a space whose outer circumference, when cut along the surface direction orthogonal to the vertical direction (that is, the axial direction of the filter chamber 72) has a circular cross-sectional shape. As shown in the lower section of FIG. 3A, the filter 73 is provided in a bottom surface 72*a* of the filter chamber 72 (the surface located on the lower side in the vertical direction). Meanwhile, a conical protruding portion 741 whose apex is on the lower side in the vertical direction is provided in a bottom surface 74*a* of the filter cover 74. This protruding portion 741 is configured as a part of an upper surface 72*b* of the filter chamber 72, and is provided so as to protrude toward a center area O of the bottom surface 72*a* of the filter chamber 72 and the filter 73. In other words, the upper surface 72*b* of the filter chamber 72 slopes downward from the outer area toward the center area O. In this manner, the filter chamber 72 is a circular column-shaped space whose center area is indented in an inverse conical shape.

The ink inflow channel 75 is a space for causing ink to flow into the filter chamber 72, and includes: a first ink inflow channel 751 that extends in the vertical direction from a bottom surface 71*a* of the main body unit 71 to the bottom surface 74*a* of the filter cover 74; a second ink inflow channel 752 that extends while curving, as shown in the upper section of FIG. 3A; and a third ink inflow channel 753 that extends in a direction tangential to the outer side surface of the filter chamber 72. The heights (positions in the vertical direction) of the second ink inflow channel 752 and the third ink inflow channel 753 are the same as the height (position in the vertical direction) of the filter chamber 72.

The ink outflow channel 76 is a space, provided below the filter 73 in the vertical direction, for allowing the ink to pass through the filter 73 and flow out from the filter chamber 72. The ink outflow channel 76 extends downward in the vertical direction from the filter 73 to the bottom surface 71*a* of the main body unit 71, and the channel thereof narrows partway along the vertical direction (that is, the cross-sectional surface area in the surface direction orthogonal to the vertical direction becomes smaller).

As shown in FIG. 2, the filter unit 70 is incorporated into each of the heads 31, and is located upstream from the common ink chamber 312 in the ink supply path. Accordingly, the ink within the sub tank 45 is supplied to the common ink chamber 312 after traversing the circulation tube 47 and passing through the filter unit 70. As shown in FIG. 3B, the ink that has passed through the filter unit 70 passes through the first ink inflow channel 751, the second ink inflow channel 752, and the third ink inflow channel 753 in that order, flows into the filter chamber 72, passes through the filter 73, and flows out from the filter unit 70 through the ink outflow channel 76.

Purpose of Filter Unit 70

As described above, when bubbles intermix with the ink within the ink chambers 311 that communicate with the nozzles Nz, the ink within the ink chambers 311 cannot be properly pressurized by driving elements, which leads to the occurrence of ink ejection problems with the nozzles Nz. Accordingly, in the printing mode, the bubbles should not be sent to the common ink chamber 312, the ink chambers 311, and so on. In other words, during the printing mode, bubbles contained in the ink should be caught by the filter 73 without flowing out downstream from the filter unit 70 (the filter 73).

Meanwhile, if the bubbles caught by the filter 73 are left as-is, those bubbles will inhibit the flow of ink passing through the filter 73. If this occurs, an insufficient amount of ink will be supplied to the common ink chamber 312, the ink chambers 311, and so on, and ink ejection problems will occur in the nozzles Nz. Accordingly, during the maintenance mode, the bubbles caught by the filter 73 should be allowed to flow downstream from the filter unit 70 (the filter 73), thus sending the bubbles to the sub tank 45, ejecting the bubbles outside of the heads 31 through the nozzles Nz, or the like.

In other words, ink ejection problems in the nozzles Nz are prevented by not allowing the bubbles to pass through the filter 73 during the printing mode but allowing the bubbles to pass through the filter 73 during the maintenance mode.

Meanwhile, the filter 73 can catch foreign objects, such as thickened ink and debris, in addition to the bubbles contained in the ink. Doing so makes it possible to suppress the nozzles Nz from clogging. Note that it is desirable to clean and replace the filter 73 as appropriate in order to prevent the filter 73 from being clogged by such foreign objects.

Effects of Filter Unit 70

Figure 4A:
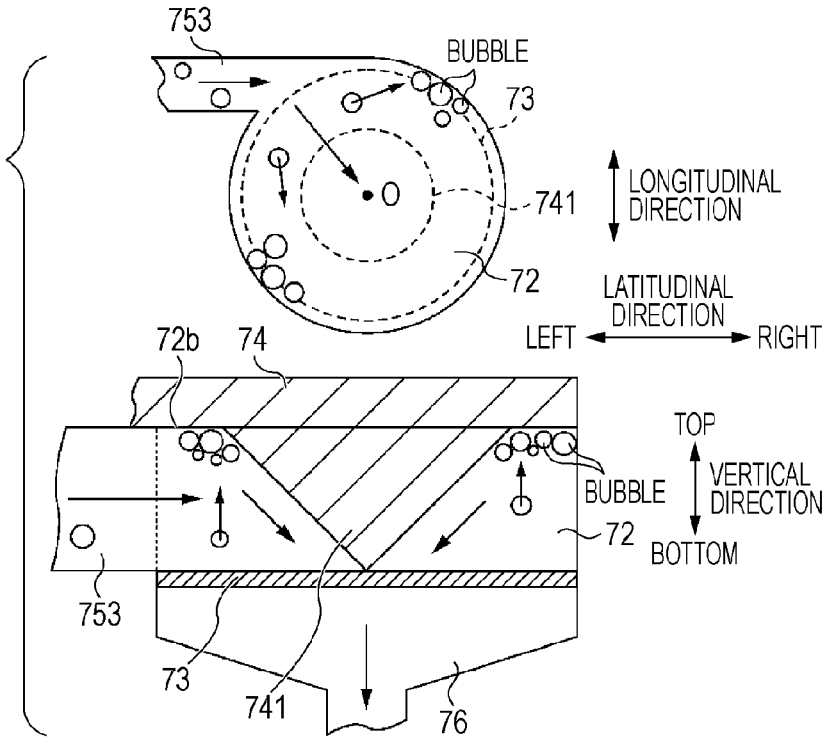
FIG. 4A is a diagram illustrating the flow of ink and bubbles during a printing mode.
Figure 4B:
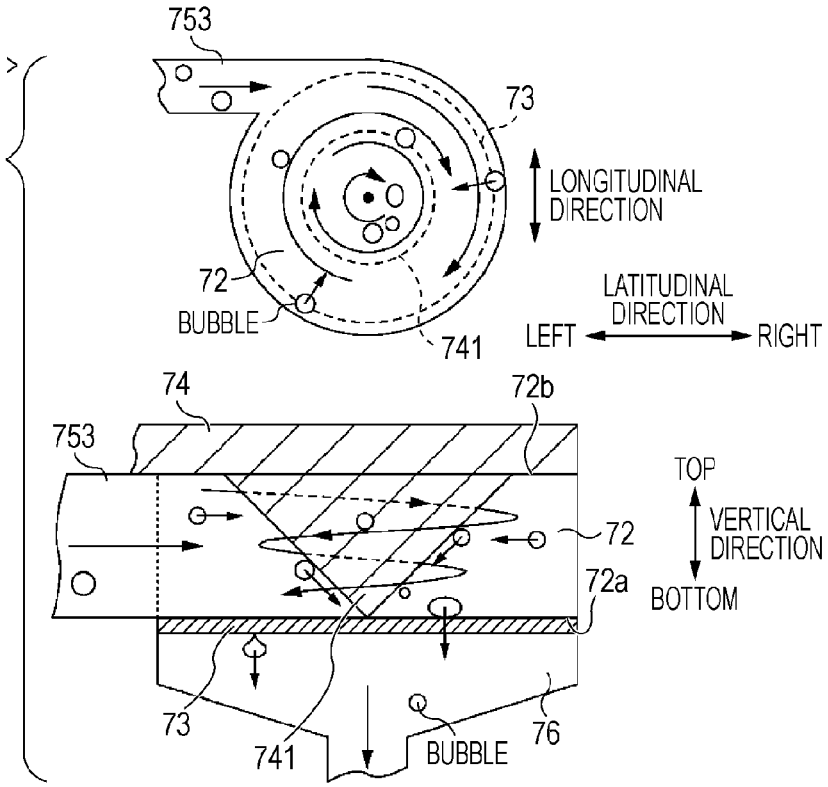
FIG. 4B is a diagram illustrating the flow of ink and bubbles during a maintenance mode.

FIG. 4A is a diagram illustrating the flow of ink and bubbles during the printing mode, and FIG. 4B is a diagram illustrating the flow of ink and bubbles during the maintenance mode. The upper sections in FIGS. 4A and 4B illustrate the third ink inflow channel 753, the filter chamber 72, and so on from above, whereas the lower sections are cross-sectional views showing the third ink inflow channel 753, the filter chamber 72, and so on from the longitudinal direction orthogonal to the vertical direction.

During the printing mode (that is, when ink is being supplied to the heads 31), the ink supplied through the sub tank 45 to the heads 31 is set to flow at a slower speed than during the maintenance mode (that is, when ink is being circulated by the circulation pump P3, when ink is being ejected from the nozzles Nz due to pressurization by the pressure adjustment pump P2, and so on). To rephrase, during the printing mode, settings are made so that the flow amount per unit of time for the ink supplied from the sub tank 45 to the heads 31 is lower than during the maintenance mode (for example, half the ink flow amount).

Accordingly, the controller 10 reduces the force with which the pressure adjustment pump P2 pressure-transfers the ink within the sub tank 45 to the heads 31 during the printing mode to a force that is lower than the force with which the circulation pump P3, the pressure adjustment pump P2, and so on pressure-transfer the ink within the sub tank 45 to the heads 31 during the maintenance mode.

Accordingly, during the printing mode, the flow speed of the ink that flows into the filter chamber 72 from the third ink inflow channel 753 is also slower (that is, there is a lower ink inflow amount per unit of time), and thus even if ink flows into the filter chamber 72 in a direction tangential to the circumferential side surface of the filter chamber 72 through the third ink inflow channel 753, the ink does not flow rotationally within the filter chamber 72, as shown in FIG. 4A. Therefore, the ink that has flowed into the filter chamber 72 passes through the filter 73 without rotational flowing around the inverse-conical shaped protruding portion 741, and then flows out to the ink outflow channel 76.

If the speed at which the ink flows during the printing mode is slow, the bubbles contained in the ink have difficulty flowing with the current of the ink. Accordingly, the bubbles float upward in the vertical direction (that is, toward the filter cover 74, the upper surface 72*b* of the filter chamber 72, and so on) due to buoyancy, without moving with the ink toward the filter 73 that is located downward in the vertical direction. The bubbles that have floated upward accumulate in the outer area (corners) of the filter chamber 72, where the flow of ink is gentle.

In other words, in the printing mode, it is possible to prevent the bubbles from accumulating in the filter chamber 72 without passing through the filter 73 and from flowing into the ink chambers 311. Accordingly, pressure can be properly applied to the ink within the ink chambers 311 by the driving elements, which makes it possible to prevent ink ejection problems in the nozzles Nz.

On the other hand, in the maintenance mode, the ink is set to flow into the filter chamber 72 from the third ink inflow channel 753 at a higher flow speed than in the printing mode. To rephrase, in the maintenance mode, the ink flow amount from the third ink inflow channel 753 into the filter chamber 72 per unit of time is set to be greater than (for example, double) the ink flow amount in the printing mode.

Accordingly, in the maintenance mode, when ink flows into the filter chamber 72 through the third ink inflow channel 753 from a direction tangential to the circumferential side surface of the filter chamber 72, the ink flows rotationally (in a vortex) within the filter chamber 72, as shown in FIG. 4B. Therefore, the ink that has flowed into the filter chamber 72 flows around the inverse-conical shaped protruding portion 741, passes through the filter 73, and then flows out to the ink outflow channel 76.

If the speed at which the ink flows during the maintenance mode is high, the bubbles contained in the ink easily flow with the current of the ink. Accordingly, the bubbles move against the force of buoyancy, toward the filter 73 that is located downward in the vertical direction, while rotating around the protruding portion 741 along with the ink. The bubbles then make contact with the filter 73.

Furthermore, due to the centrifugal force produced by the rotational flow of the ink within the filter chamber 72, the ink, which has a high relative density, moves toward the outer area of the filter chamber 72, whereas the bubbles, which have a low relative density, move toward the center area of the filter chamber 72. Accordingly, bubbles that accumulated in the outer area (the upper corners) of the filter chamber 72 during the printing mode, fine bubbles that have difficulty flowing with the current of the ink, and so on move toward the center area of the filter chamber 72, as shown in FIG. 4B.

The inverse conical-shaped protruding portion 741 that protrudes toward the center area O of the bottom surface 72*a* of the filter chamber 72 (that is, toward the filter 73) is provided within the filter chamber 72. Accordingly, the interval between the upper surface 72*b* of the filter chamber 72 and the bottom surface 72*a* (that is, the interval between the filter cover 74 and the filter 73) becomes gradually narrower from the outer area toward the center area of the filter chamber 72. Accordingly, when the bubbles move toward the center area of the filter chamber 72 due to the influence of the centrifugal force produced by the rotational flow of the ink, the bubbles move downward in the vertical direction along the circumferential side surface of the protruding portion 741. The bubbles then make contact with the filter 73. In other words, the protruding portion 741 fulfills a role of suppressing buoyancy in the bubbles that move toward the center area of the filter chamber 72 and directing the bubbles toward the filter 73 that is located downward in the vertical direction.

In this manner, when the bubbles make contact with the filter 73, pressure is applied to the bubbles (that is, a force that pushes the bubbles is produced) by the ink that attempts to flow from the filter chamber 72, through the filter 73, and out to the ink outflow channel 76. When the pressure applied to the bubbles exceeds the capillary force of the filter 73 (that is, the pressure at which the ink passes through the fine holes in the filter 73), the bubbles pass through the filter 73. In this manner, dynamic pressure applied to the ink during the maintenance mode is set to a pressure that enables the bubbles contained in the ink to pass through the filter 73, so that the bubbles can pass through the filter 73 during the maintenance mode. In order to accomplish this, the speed at which the ink flows into the filter chamber 72 and so on is adjusted. The bubbles that have passed through the filter 73 flow out from the filter unit 70 via the ink outflow channel 76; the bubbles are then sent to the sub tank 45 and burst on the liquid surface of the ink, are discharged to the exterior of the heads 31 from the nozzles Nz, or the like.

Figure 5A:
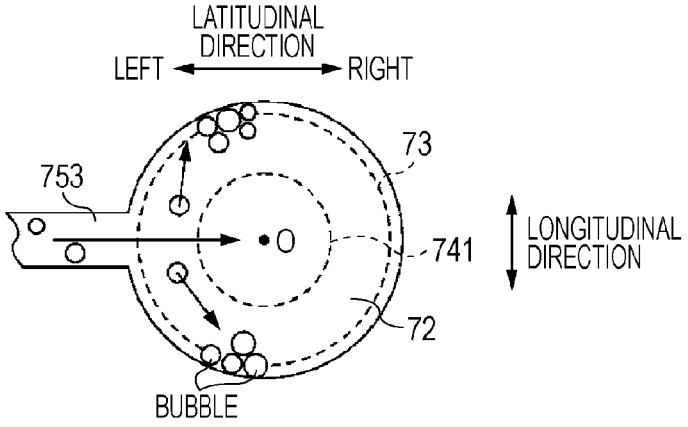
FIG. 5A and FIG. 5B are diagrams illustrating a filter unit according to a comparative example.
Figure 5B:
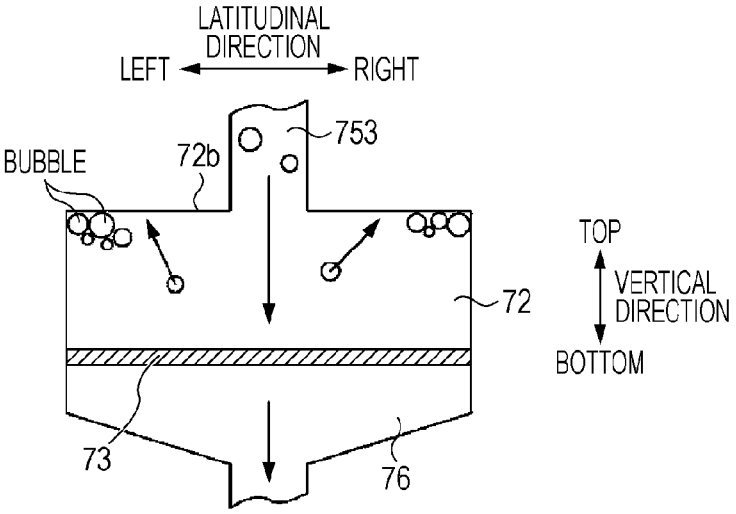

FIG. 5A and FIG. 5B are diagrams illustrating a filter unit according to a comparative example. In FIG. 5A, the ink flows into the filter chamber 72 toward the center area of the filter chamber 72 from a radial direction, whereas in FIG. 5B, the ink flows into the filter chamber 72 from the upper surface 72*b* of the filter chamber 72.

In these cases, the ink within the filter chamber 72 does not flow rotationally even if the ink flows into the filter chamber 72 at a high rate of speed. If such is the case, the bubbles will not move toward the center area of the filter chamber 72, and thus even if the protruding portion 741 is provided in the filter chamber 72 as shown in FIG. 5A, the protruding portion 741 cannot cause the bubbles to move toward the filter 73. Accordingly, with the filter units according to the comparative examples, the bubbles cannot be caused to flow out downstream from the filter 73 even during the maintenance mode, and thus the bubbles accumulating in the outer areas (the top corners) of the filter chamber 72.

Accordingly, causing the ink to flow into the filter chamber 72 through the third ink inflow channel 753 from a direction tangential to the side circumferential surface of the filter chamber 72, as is the case with the filter unit 70 according to this embodiment, makes it possible to cause the ink to flow rotationally within the filter chamber 72. Doing so makes it possible to cause the bubbles to move toward the filter 73 along the protruding portion 741 while also causing the bubbles to move toward the center area of the filter chamber 72, which results in the bubbles coming into contact with the filter 73; this in turn makes it possible to remove the bubbles from the filter chamber 72. Accordingly, it is possible to prevent the bubbles from inhibiting the flow of ink supplied to the common ink chamber 312, the ink chambers 311, and so on, which makes it possible to sufficiently supplying the ink to the common ink chamber 312, the ink chambers 311, and so on; this in turn makes it possible to prevent ink ejection problems in the nozzles Nz.

Conclusion

The filter unit 70 according to this embodiment includes: the filter chamber 72 (corresponding to a space portion), through which ink passes, whose outer cross-sectional shape when cut along the direction (surface direction) orthogonal to the axial direction (the vertical direction in FIG. 3A) is circular; the filter 73 provided at the surface on one end (the bottom surface 72*a* in FIG. 3A) of the filter chamber 72 in the axial direction thereof; the protruding portion 741 (corresponding to a protruding member), provided at the surface (the upper surface 72*b* in FIG. 3B) on the other end of the filter chamber 72 in the axial direction thereof, that protrudes toward a center area of the surface (the bottom surface 72*a*) on the one end of the filter chamber 72; the ink inflow channel 75 (corresponding to an inflow channel) that allows the ink to flow into the filter chamber 72 from a direction tangential to the side circumferential surface of the filter chamber 72; and the ink outflow channel 76 (corresponding to an outflow channel) that allows the ink to pass through the filter 73 and flow out from the filter chamber 72.

According to this filter unit 70, in the case where the ink has flowed into the filter chamber 72 from the ink inflow channel 75 at a high rate of speed, the ink can be caused to flow rotationally within the filter chamber 72. If such is the case, the centrifugal force produced by the rotational flow of the ink can cause the bubbles, which are lighter than the ink, to move toward the center area of the filter chamber 72. At this time, the bubbles can be caused to move toward the filter 73 along the protruding portion 741, which slopes downward from the outer area of the filter chamber 72 toward the center area of the filter chamber 72. Doing so makes it possible to cause fine bubbles, which do not flow easily with the current of the ink and do not easily come into contact with the filter 73, as well as bubbles that have accumulated in the outer area of the filter chamber 72, to come into contact with the filter 73, which in turn makes it possible to cause the bubbles to flow out toward the downstream side of the filter 73.

In other words, with the filter unit 70 according to this embodiment, more bubbles can be caused to flow out downstream from the filter 73 during the maintenance mode, which makes it possible to improve the ability to remove bubbles from the ink within the filter unit 70. Accordingly, it is possible to prevent the bubbles from flowing to the ink chambers 311, the bubbles from inhibiting the supply of ink, and so on during the printing mode, which in turn makes it possible to prevent ink ejection problems in the nozzles Nz.

Meanwhile, in the case where the ink has flowed into the filter chamber 72 from the ink inflow channel 75 at a low rate of speed, the ink does not flow rotationally within the filter chamber 72; as a result, the bubbles do not move toward the center area of the filter chamber 72, and do not move toward the filter 73 along the protruding portion 741. In this case, the bubbles can be prevented from flowing out downstream from the filter 73.

In other words, the bubbles can be caused to flow out downstream from the filter 73 or prevented from flowing out as appropriate by adjusting the speed at which the ink flows into the filter chamber 72 and to cause or not cause the ink to flow rotationally within the filter chamber 72.

Meanwhile, the printer 1 according to this embodiment includes the sub tank 45 (corresponding to a liquid holding unit) that holds the ink, and the heads 31 provided with the nozzles Nz capable of ejecting the ink; the filter unit 70 is provided upstream from the common ink chamber 312 (that is, between the sub tank 45 and the nozzles Nz). The printer 1 includes: a printing mode (corresponding to a first mode) that causes the ink to flow into the filter chamber 72 from the third ink inflow channel 753 at a flow speed that does not allow bubbles contained in the ink to flow out downstream from the filter 73; and a maintenance mode (corresponding to a second mode) that causes the ink to flow into the filter chamber 72 from the third ink inflow channel 753 at a flow speed that allows bubbles contained in the ink to flow out downstream from the filter 73.

To describe further, in the printing mode, the ink is caused to flow into the filter chamber 72 from the third ink inflow channel 753 at a speed that does not cause the ink to flow rotationally within the filter chamber 72, which ensures that the bubbles contained in the ink do not flow out downstream from the filter 73; however, in the maintenance mode, the ink is caused to flow into the filter chamber 72 from the third ink inflow channel 753 at a speed that causes the ink to flow rotationally within the filter chamber 72, which enables the bubbles contained in the ink to flow out downstream from the filter 73.

According to this printer 1, during the printing mode, the bubbles can be prevented from flowing into the ink chambers 311, and a proper pressure can be applied to the ink within the ink chambers 311 by the driving elements; this makes it possible to prevent ink ejection problems in the nozzles Nz. On the other hand, during the maintenance mode, the bubbles can be prevented from inhibiting the flow of ink that passes through the filter 73, and the ink can be sufficiently supplied to the common ink chamber 312, the ink chambers 311, and so on; this makes it possible to prevent ink ejection problems in the nozzles Nz.

Meanwhile, in the printer 1 according to this embodiment, the dynamic pressure applied to the ink in the maintenance mode is set to a pressure that allows the bubbles contained in the ink to pass through the filter 73.

To rephrase, during the printing mode, the speed at which the ink flows into the filter chamber 72 and so on is set so that the pressure exerted on the bubbles by the ink that passes through the filter 73 is less than the capillary force of the filter 73, whereas during the maintenance mode, the speed at which the ink flows into the filter chamber 72 and so on is set so that the pressure exerted on the bubbles by the ink that passes through the filter 73 is greater than the capillary force of the filter 73.

Doing so makes it possible to prevent the bubbles from flowing out downstream from the filter 73 during the printing mode, and makes it possible to allow the bubbles to flow out downstream from the filter 73 during the maintenance mode.

Figure 6:
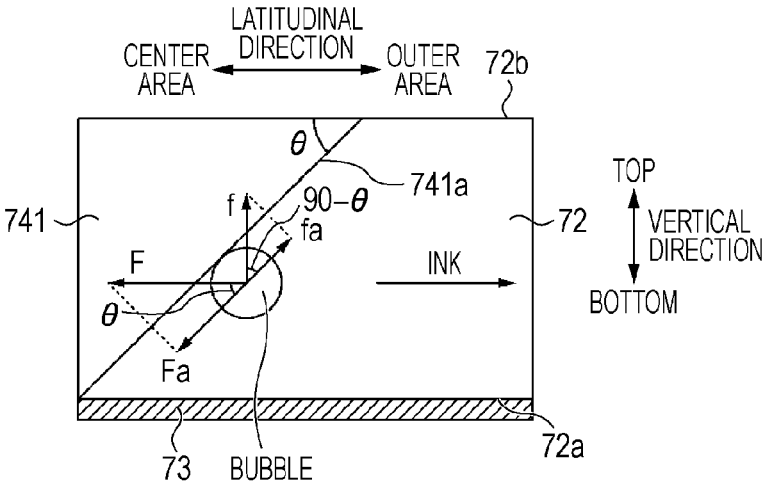
FIG. 6 is a diagram illustrating the angle of slope of a protruding portion.

FIG. 6 is a diagram illustrating an angle of slope θ of the protruding portion 741. When a rotational flow is produced within the filter chamber 72 during the maintenance mode, the centrifugal force causes the ink, which has a high relative density, to accumulate in the outer area of the filter chamber 72, and causes the bubbles, which have a low relative density, to accumulate in the center area of the filter chamber 72. In FIG. 6, the force that brings the bubbles toward the center area of the filter chamber 72 is indicated as "F", and the buoyancy of the bubbles is indicated as "f". In addition, the angle of slope of the protruding portion 741, or in other words, the angle formed between the upper surface 72*b* of the filter chamber 72 and a side circumferential surface 741*a* of the protruding portion 741, is indicated as "θ".

Of the force F that brings the bubbles toward the center area of the filter chamber 72, the component corresponding to a force following the side circumferential surface 741*a* of the protruding portion 741, or Fa (=F·COS θ), is a force that brings the bubbles toward the filter 73. Meanwhile, of the buoyancy f of the bubbles, the component corresponding to a force following the side circumferential surface 741*a* of the protruding portion 741, or fa (=f·COS(90°-θ), is a force that brings the bubbles toward the upper surface 72*b* of the filter chamber 72. During the maintenance mode, by increasing the force Fa that brings the bubbles toward the filter 73 beyond the force fa that brings the bubbles toward the upper surface 72*b* of the filter chamber 72, the bubbles can be brought toward the filter 73.

Accordingly, with the filter unit 70 according to this embodiment, the slope θ of the side circumferential surface 741*a* of the protruding portion 741 relative to the upper surface 72*b* of the filter chamber 72 is set so that the bubbles move toward the filter 73 (downward in the vertical direction) against the buoyancy f during the maintenance mode. Doing so makes it possible to bring the bubbles and the filter 73 into contact during the maintenance mode, which in turn makes it possible to cause the bubbles to flow out downstream from the filter 73.

Meanwhile, the protruding portion 741 in the filter unit 70 according to this embodiment has a circular conical shape whose apex is on one end (the downward side in the vertical direction, where the filter 73 is provided) in the axial direction (the vertical direction in FIG. 3A) of the filter chamber 72.

By doing so, the bubbles can be brought toward the filter 73 smoothly along the smooth side circumferential surface of the protruding portion 741. If the protruding portion 741 has a stepped shape, there is a risk that bubbles will accumulate at the corners thereof. Accordingly, setting the protruding portion 741 to a circular conical shape makes it possible to prevent the bubbles from accumulating, and thus more bubbles can be caused to flow out downstream from the filter 73 during the maintenance mode.

Meanwhile, in the filter unit 70 according to this embodiment, the apex of the protruding portion 741 makes contact with the filter 73.

By doing so, it is possible to narrow the interval between the side circumferential surface of the protruding portion 741 and the filter 73, which in turn makes it possible to bring even fine bubbles into contact with the filter 73. Meanwhile, if the apex of the protruding portion 741 is not in contact with the filter 73, there is a risk that bubbles will accumulate in the space between the apex of the protruding portion 741 and the filter 73. Accordingly, bringing the apex of the protruding portion 741 into contact with the filter 73 makes it possible to prevent the bubbles from accumulating, and thus more bubbles can be caused to flow out downstream from the filter 73 during the maintenance mode.

Meanwhile, with the printer 1 according to this embodiment, during the maintenance mode, the ink within the sub tank 45 is pressure-transferred to the heads 31 by the circulation pump P3, and the ink within the heads 31 is then returned to the sub tank 45. After this, the ink within the sub tank 45 is pressure-transferred to the heads 31 and the ink within the heads 31 is pressurized by the pressure adjustment pump P2, and the ink is ejected through the nozzles Nz. In other words, during the maintenance mode, the ink is pressure-transferred from the sub tank 45 to the heads 31, the ink within the heads 31 is pressurized, and the ink is ejected through the nozzles Nz.

In this manner, when the ink within the heads 31 is pressurized, the bubbles contained in the ink within the heads 31 (within the filter chamber 72) shrink. As described earlier, fine bubbles have difficulty flowing with the current of the ink, and have difficulty coming in contact with the filter 73 if the bubbles rise due to buoyancy; therefore, such fine bubbles have difficulty passing through the filter 73. In other words, in the case where the ink within the heads 31 is pressurized during the maintenance mode, the bubbles within the filter chamber 72 will shrink, and the ability to remove the bubbles from the filter unit 70 will decrease.

However, even in such a case, using the filter unit 70 according to this embodiment makes it possible to bring the bubbles toward the filter 73 via the protruding portion 741 while also bringing the bubbles toward the center due to the centrifugal force produced when the ink flows rotationally. Accordingly, even fine bubbles can be brought into contact with the filter 73, which makes it possible to improve the ability to remove bubbles from the filter unit 70.

Variations

Figure 7:
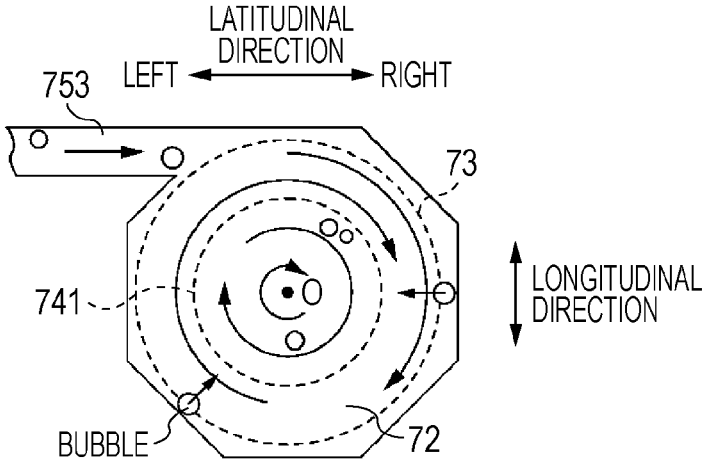
FIG. 7 is a diagram illustrating a filter chamber according to a variation.

FIG. 7 is a diagram illustrating the filter chamber 72 according to a variation. FIG. 7 illustrates the filter chamber 72 and the like seen from above. The outer cross-sectional shape when the filter chamber 72 cut along the surface direction, which is orthogonal to the axial direction, may be a space of a polygonal shape (in FIG. 7, an octagon). In other words, the filter chamber 72 may have a space in which the center area of a polygonal column has a shape that is indented as an inverse cone.

Even with such a filter chamber 72, during the maintenance mode, the ink within the filter chamber 72 can be caused to flow rotationally by causing the ink to flow into the filter chamber 72 from the third ink inflow channel 753 that extends in a direction tangential to the side circumferential surface of the filter chamber 72.

In addition, although the aforementioned embodiment describes the third ink inflow channel 753 as extending in a direction tangential to the side circumferential surface of the filter chamber 72, the invention is not limited thereto, and the third ink inflow channel 753 may extend in a direction at an angle slightly shifted from the tangential direction. Even in such a case, the ink can be caused to flow rotationally within the filter chamber 72 during the maintenance mode. In other words, the ink is not limited to flowing into the filter chamber 72 from a direction that is strictly tangential to the side circumferential surface of the filter chamber 72, and the ink may flow into the filter chamber 72 from any direction as long as that direction is capable of producing a rotational flow in the ink (that is, is an approximately tangential direction).

In addition, although the aforementioned embodiment describes the shape of the protruding portion 741 located within the filter chamber 72 as being a circular conical shape, the invention is not limited thereto. For example, the protruding portion 741 may have a triangular conical shape, a dome shape, a circular conical trapezoid shape, a stepped shape that has small steps, or the like. In other words, the protruding portion 741 may have any shape as long as that shape is capable of bringing bubbles moving toward the center area of the filter chamber 72 due to centrifugal force in the direction of the filter 73 located below.

In addition, although the aforementioned embodiment describes the apex of the protruding portion 741 is making contact with the center area O of the filter 73, the invention is not limited thereto. For example, the apex of the protruding portion 741 may make contact with a position that is offset from the center area O of the filter 73, or the apex of the protruding portion 741 may make no contact with a filter 73.

In addition, although the aforementioned embodiment describes bubbles being sent to the sub tank 45 by circulating the ink within the sub tank 45 using the circulation pump P3, discharging the bubbles from the nozzles Nz by pressurizing the ink within the heads 31 using the pressure adjustment pump P2, and so on during the maintenance mode, the invention is not limited thereto. For example, during the maintenance mode, the heads 31 and the caps may be brought into contact so as to form an airtight space between the nozzle surfaces of the heads 31 and the caps, and the bubbles may be discharged from the nozzles Nz along with ink by producing a negative pressure in those airtight spaces using a suction pump.

In addition, although the aforementioned embodiment describes the filter unit 70 being incorporated into the head 31 in an orientation in which the filter 73 is located below the filter cover 74 in the vertical direction, the invention is not limited thereto. For example, the filter unit 70 illustrated in the lower section of FIG. 3A may be rotated 90° so that the surface of the filter 73 follows the vertical direction, or the filter unit 70 may be rotated a further 45° so that the filter 73 is located above the filter cover 74 in the vertical direction and the surface of the filter 73 follows an angle in the vertical direction. However, if the filter unit 70 illustrated in the lower section of FIG. 3A is rotated 180°, the filter 73 will be located completely above the filter cover 74 in the vertical direction, and thus there is a risk that bubbles will make contact with the filter 73 due to buoyancy, and will thus pass through the filter 73, even during the printing mode.

In addition, although the aforementioned embodiment describes the filter unit 70 as being incorporated into the head 31 and the filter unit 70 being provided immediately above the common ink chamber 312, the invention is not limited thereto. The filter unit 70 may be provided in any position between the sub tank 45 and the nozzles Nz.

Other Embodiments

Although the aforementioned embodiment primarily describes a liquid ejecting apparatus, the embodiment also includes disclosures of a filter unit, a bubble removal method, and so on. In addition, the aforementioned embodiment has been provided to facilitate understanding of the invention and is not to be interpreted as limiting the invention in any way. Many variations and modifications can be made without departing from the essential spirit of the present invention, and thus all such variations and modifications also fall within the scope of the present invention.

Liquid Ejecting Apparatus

Although the aforementioned embodiment describes an ink jet printer as an example of a liquid ejecting apparatus, the invention is not limited thereto. For example, the liquid ejecting apparatus may be a color filter manufacturing apparatus, a display manufacturing apparatus, a semiconductor manufacturing apparatus, a DNA chip manufacturing apparatus, or the like.

Printer

Although the aforementioned embodiment describes the printer 1, in which the medium S passes below a plurality of fixed heads 31, as an example, the invention is not limited thereto. For example, the printer may be a printer that alternately repeats an operation for ejecting ink from a head that moves in a predetermined direction and an operation for transporting a medium in a direction orthogonal to the predetermined direction, or may be a printer that alternately repeats an operation for ejecting ink from a head that moves in a predetermined direction and an operation for moving the head relative to the medium in a direction orthogonal to a predetermined direction.

What is claimed is:

1. An inkjet head comprising:

a main body portion that defines a space through which a liquid passes;

an inflow channel that allows the liquid to flow into the space, the inflow channel defining an inflow direction of the liquid that flows into the space;

an outflow channel that allows the liquid to flow out from the space, the outflow channel defining an outflow direction of the liquid that flows out from the space;

a filter provided in the space, the filter crossing a flow of the liquid that passes through the space; and a protruding portion that defines a part of the space and that protrudes toward the filter, the protruding portion including:

an apex, a bottom that is located farther away from the filter than the apex, and a side that slopes from the bottom toward the apex in the outflow direction.

2. The inkjet head according to claim 1, wherein the apex makes contact with the filter.

3. The inkjet head according to claim 1, wherein the inflow direction is a direction that crosses the outflow direction.

4. The inkjet head according to claim 1, wherein the bottom has a cross-sectional shape that is circular or polygonal when cut along the inflow direction.

5. The inkjet head according to claim 1, wherein the main body portion has an outer cross-sectional shape that is circular or polygonal when cut along the inflow direction.

6. A liquid ejecting apparatus including the inkjet head according to claim 1.

* * * * *